US007123125B2

(12) United States Patent
Liu

(10) Patent No.: US 7,123,125 B2
(45) Date of Patent: Oct. 17, 2006

(54) STRUCTURE OF A SURFACE MOUNTED RESETTABLE OVER-CURRENT PROTECTION DEVICE AND METHOD FOR MANUFACTURING THE SAME

(75) Inventor: Wen-Lung Liu, Panchiao (TW)

(73) Assignee: Inpaq Technology Co., Ltd., Miao Li Hsien (TW)

( * ) Notice: Subject to any disclaimer, the term of this patent is extended or adjusted under 35 U.S.C. 154(b) by 0 days.

(21) Appl. No.: 11/106,074

(22) Filed: Apr. 14, 2005

(65) Prior Publication Data

US 2005/0190522 A1 Sep. 1, 2005

Related U.S. Application Data

(62) Division of application No. 09/991,846, filed on Nov. 16, 2001, now abandoned.

(30) Foreign Application Priority Data

May 3, 2001 (CN) ..... 90110654

(51) Int. Cl.
*H01C 7/10* (2006.01)

(52) U.S. Cl. ..... 338/20; 338/22 R

(58) Field of Classification Search ..... 338/20, 338/21, 22 R, 22 SD, 52, 54, 308, 313, 314, 338/324, 328, 332; 29/610.1, 612; 438/113, 438/114, 458; 257/700, 783

See application file for complete search history.

(56) References Cited

U.S. PATENT DOCUMENTS 2,864,013 A * 12/1958 Wood ..... 338/22 R
4,786,888 A * 11/1988 Yoneda et al. ..... 338/22 R
4,959,505 A 9/1990 Ott
4,993,142 A 2/1991 Burke et al.
5,351,390 A * 10/1994 Yamada et al. ..... 29/612
5,831,510 A 11/1998 Zhang et al.
5,884,391 A 3/1999 McGuire et al.
5,950,070 A * 9/1999 Razon et al. ..... 438/113
6,223,423 B1 5/2001 Hogge
6,242,997 B1 6/2001 Barrett et al.
6,285,275 B1 9/2001 Chen et al.
6,297,722 B1 10/2001 Yeh
6,420,244 B1 * 7/2002 Lee ..... 438/458
6,429,533 B1 8/2002 Li et al.
6,556,123 B1 4/2003 Iwao et al.
6,609,292 B1 * 8/2003 Kurita ..... 29/610.1
6,838,972 B1 1/2005 Minervini et al.
2001/0000658 A1 5/2001 Barrett et al.

FOREIGN PATENT DOCUMENTS

JP 9-260106 10/1997

* cited by examiner

*Primary Examiner*—Tu Hoang
(74) *Attorney, Agent, or Firm*—Senniger Powers

(57) ABSTRACT

The present invention is directed to a structure of a surface mounted resettable over-current protection device and a method for manufacturing the same. First, a raw material substrate having two ends is provided. On each of the two ends of the raw material substrate, a patterned conducting metal foil is formed. Then, the raw material substrate is cut to form a grid-shaped substrate having a plurality of strip-shaped structural parts. An insulating layer is formed to enclose the whole grid-shaped substrate, allowing parts of the patterned metal foil layers on the ends of the strip-shaped structural parts to be exposed. Next, the strip-shaped structural parts of the grid-shaped substrate are cut into a plurality of chips, each chip having two cut sections. Finally, two terminal electrodes are formed on the both cut sections of each chip.

14 Claims, 10 Drawing Sheets

STRUCTURE OF A SURFACE MOUNTED RESETTABLE OVER-CURRENT PROTECTION DEVICE AND METHOD FOR MANUFACTURING THE SAME

CROSS-REFERENCE TO RELATED APPLICATION

This application is a divisional of U.S. Non-Provisional application Ser. No. 09/991,846, filed Nov. 16, 2001 now abandoned.

BACKGROUND OF THE INVENTION

1. Field of the Invention

The invention relates to a structure of a surface mounted resettable over-current protection device and a method for manufacturing the same, and in particular to a surface mounted resettable over-current protection device formed without using through holes and electroplating process and having five-conducting surface terminal electrodes, and a method for manufacturing the same.

2. Description of the Related Art

To prevent electronic systems from over-current damages caused by an abnormal condition, more and more electronic systems are provided with over-current protection devices. With such an provision, damages can be confined to the over-current protection devices when an over-current problem occurs in the electronic systems. A further concept is that costs for after-sale services and maintenance are greatly reduced if the protection devices can perform protection functions once over-current occurs and then they return to the normal condition. For these reasons, a fusible over-current protection device is gradually replaced with a polymer positive temperature coefficient (PPTC) material-based resettable over-current protection device which is widely used in various electronic systems. For high-density integration applications of the electronic systems, a resettable over-current protection device can be divided into a DIP type and a surface mounted type. Both types are used in packaging, wherein the growth rate of the need for the surface mounted type prevails over that of the DIP type.

A feature of a resettable over-current protection device is that when a current flowing through a polymer positive temperature coefficient material is over an upper limit, the temperature of the device rises to cause the original lowest resistance to increase rapidly so as to limit the current flow. A simplest polymer positive temperature coefficient material structure utilizes a polymer positive temperature coefficient material, and like a conventional two-sided printed circuit board (PCB), each of the two opposite sides of which is provided with a conducting metal foil. Therefore, the development of a prior surface mounted resettable over-current protection device is based on a printed circuit board process, wherein electrodes are formed by electroplating through holes of a substrate.

FIGS. 1–7 show a flow chart of manufacturing a conventional surface mounted resettable over-current protection device. Referring first to FIG. 1, a raw material substrate 100 having a polymer positive temperature coefficient material layer is provided. On each of the two opposite surfaces of the substrate 100, a conducting metal foil 102 is formed.

Next, referring to FIGS. 2 and 3, through holes 104 are formed using an automatic driller, and then, the inner walls of the holes are electroplated to form conducting layers 106 to thereby connect the conducting metal foils 102 on the two sides of the raw material substrate 100.

Referring to FIGS. 4 and 5, a plurality of trenches 107 are formed on the conducting metal foils 102 by photolithography and etching in the printed circuit board process so as to form bodies of surface mounted resettable over-current protective devices. After that, an insulating solder mask 108 is formed on the both side of main structures.

Finally, referring to FIGS. 6 and 7, the entire substrate 100 is cut into a plurality of surface mounted resettable over-current protection devices along cutting lines.

The terminal electrodes of the conventional surface mounted resettable over-current protection devices are mainly formed by through holes and electroplating processes. Basically, the conducting metal foils on the two sides of the substrate are connected to each other via the conducting layers formed on the inner walls of the through holes. Due to the limitation on the sizes of the electrodes, the diameters of the though holes are limited, resulting in an effect on the performance of the resistance of the terminal electrodes.

In a process for forming conventional surface mounted resettable over-current protection devices, the area of a polymer positive temperature coefficient raw material substrate can only be enlarged to a certain level, and there still is a great difference in area as compared with a substrate used in a real printed circuit board process. Therefore, completely using a printed circuit board process to manufacture a surface mounted resettable over-current protection device should take adjustments in process and economics into consideration.

Furthermore, since automatic drilling and through holes electroplating apparatuses are required to form the terminal electrodes of the surface mounted resettable over-current protection devices, it incurs more costs spent therefor. Meanwhile, for a new process, re-learning is necessary.

In view of the above, an object of the invention is to provide a structure of a surface mounted resettable over-current protection device and a method for manufacturing the same. The terminal electrodes of the device can be formed without using through holes and electroplating processes. The device can be efficiently and economically manufactured by a process for manufacturing a passive resistor terminal electrodes structure which is already used for mass production.

SUMMARY OF THE INVENTION

To attain the above-stated object, in a structure of a surface mounted resettable over-current protection device and a method for manufacturing the same, a raw material substrate is provided. On each of the two sides of the raw material substrate, a patterned conducting metal foil is formed. Then, the raw material substrate is cut to form a grid-shaped substrate having a plurality of strip-shaped structural parts. An insulating layer is formed to enclose the whole grid-shaped substrate, allowing parts of the patterned metal foil layers on the terminals of the strip-shaped structural parts to be exposed. Next, the strip-shaped structural parts of the grid-shaped substrate are cut into a plurality of chips, each chip having two cut sections. Finally, two terminal electrodes are formed on the both cut sections of each chip. Each terminal electrode includes a conducting paste and a soldering layer. The soldering layer includes a nickel layer and a tin/lead alloy layer. The conducting paste is electrically connected to one cut section which exposes part of the conducting metal foil. The soldering layer is then electrically connected to the conducting paste. Each terminal electrode has five conducting surfaces.

In the present invention, a number of variations can be made on the two cut sections of each chip. For example, parts of the insulating layer on the edges of the chip adjacent to the cut sections are removed to expose parts of the patterned conducting metal foils. For subsequently-formed terminal electrodes, it increases the contact areas between the exposed conducting metal foils and the terminal electrodes. As a result, the performances of the device in resistance and adherence are greatly improved.

Furthermore, the terminal electrodes each having five contact surfaces of the present invention is completely different from that of the prior art. Since the structure of the terminal electrodes of the present invention greatly increases the contact areas of the terminal electrodes, the performances of the device in electricity and adherence are efficiently improved.

The present invention will become more fully understood from the detailed description given hereinbelow and the accompanying drawings, which are provided to illustrate preferred embodiments only and should not be construed as limiting the scope of the present invention.

BRIEF DESCRIPTION OF THE DRAWINGS

FIGS. 8–11, FIG. 12B and FIG. 13B are schematic diagrams showing a method of manufacturing a surface mounted resettable over-current protection device according to another preferred embodiment of the invention;

LIST OF REFERENCE NUMERALS FOR MAJOR ELEMENTS

100 Raw Material Substrate
102 Conducting Metal Foils
104 Through Holes
106 Connecting Conductors
108 Insulating solder mask
110 Cutting Line
200 Raw Material Substrate
202 Conducting Metal Foils
204 Trench Structures
206*a* Cutting Line
206*b* Cutting Line
206*c* Cutting Line
210 Grid-Shaped Substrate
212 Insulating Layer
214 Cutting Lines
216 Chip
218 Terminal Electrodes

DETAILED DESCRIPTION OF PREFERRED EMBODIMENTS

FIGS. 8–11, FIGS. 12A and 13A show a method of manufacturing a surface mounted resettable over-current protection device according to a preferred embodiment of the invention, and FIGS. 8–11, FIG. 12B and FIG. 13B show a method of manufacturing a surface mounted resettable over-current protection device according to another preferred embodiment of the invention. First, referring to FIG. 8, a raw material substrate 200, for example, a polymer positive temperature coefficient material layer, is provided. A conducting metal foil 202, such as a copper or nickel foil, is formed on each of the two opposite sides of the raw material substrate 200.

Figure 1:
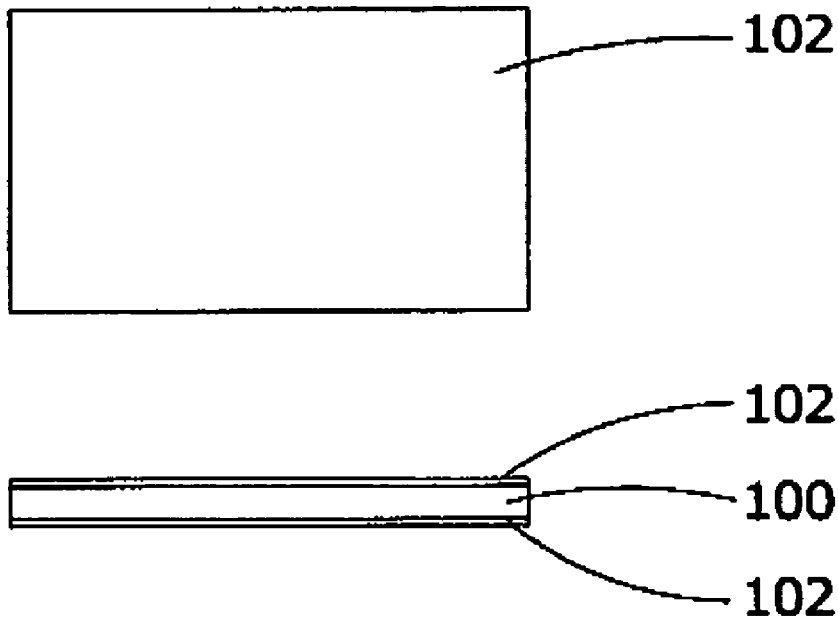
FIG. 1 PRIOR ART
FIGS. 1–7 show a flow chart of manufacturing a conventional surface mounted resettable over-current protection device.
Figure 2:
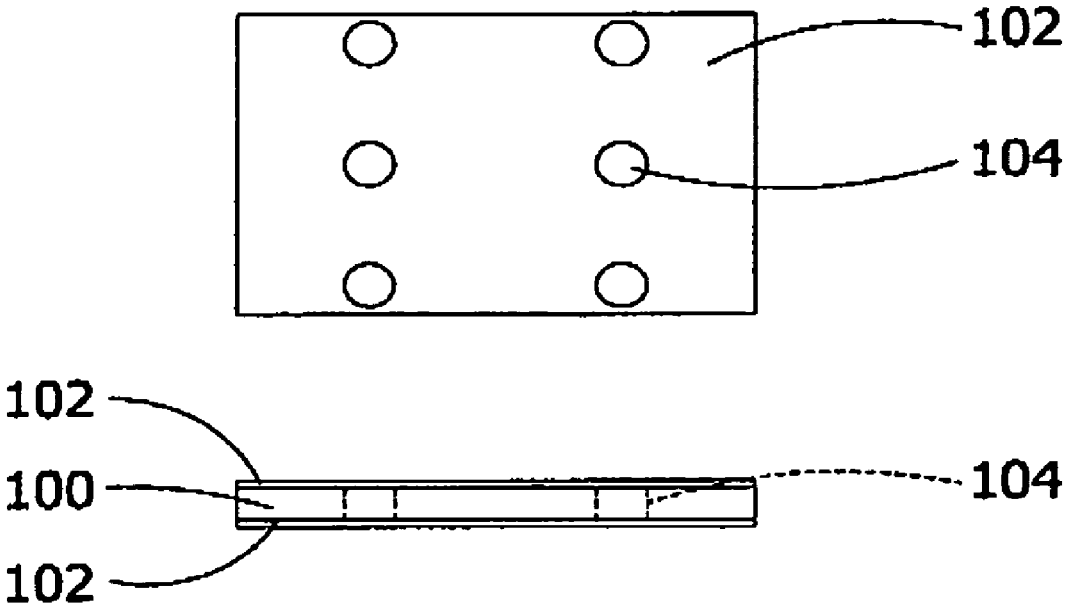
FIG. 2 PRIOR ART
Figure 3:
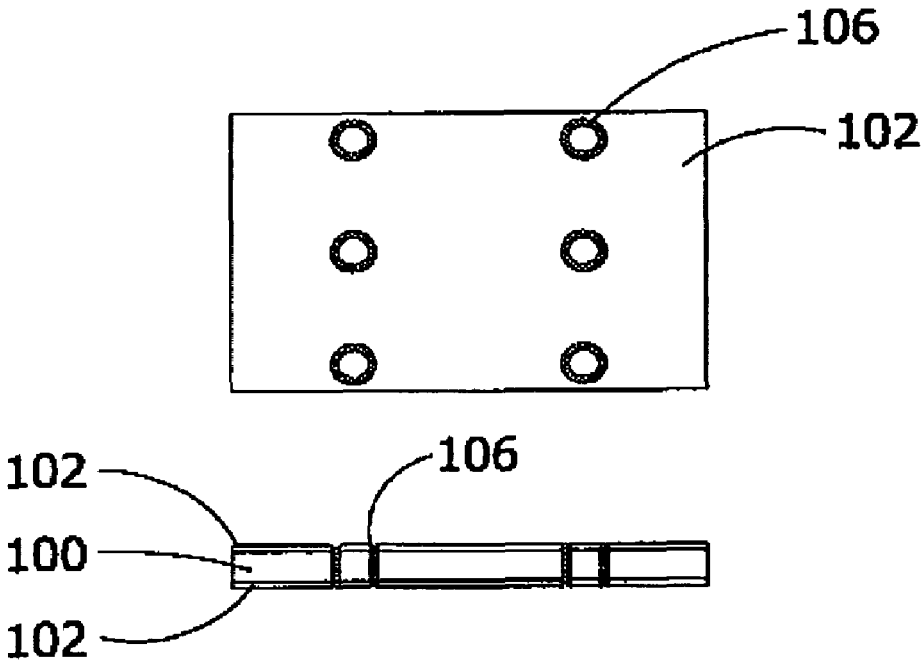
FIG. 3 PRIOR ART
Figure 4:
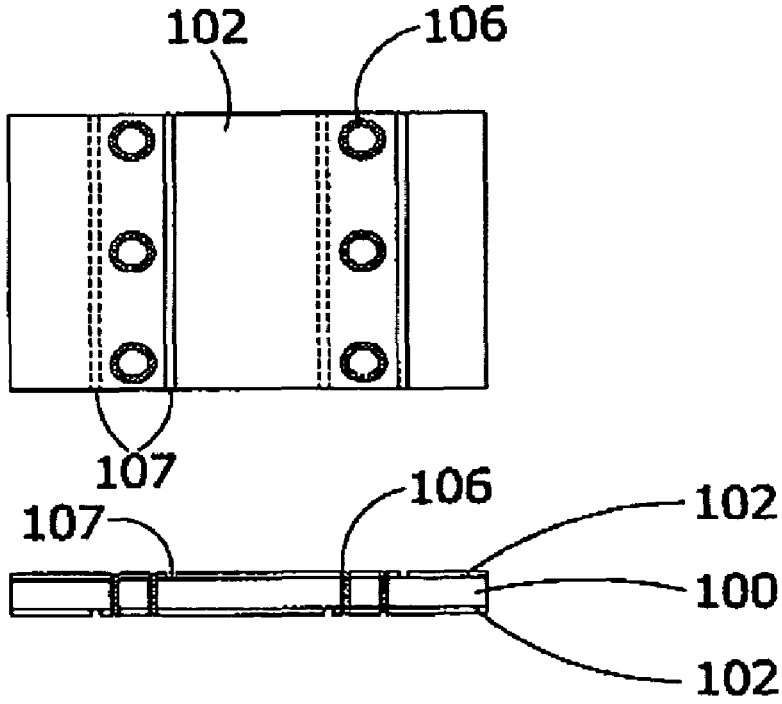
FIG. 4 PRIOR ART
Figure 5:
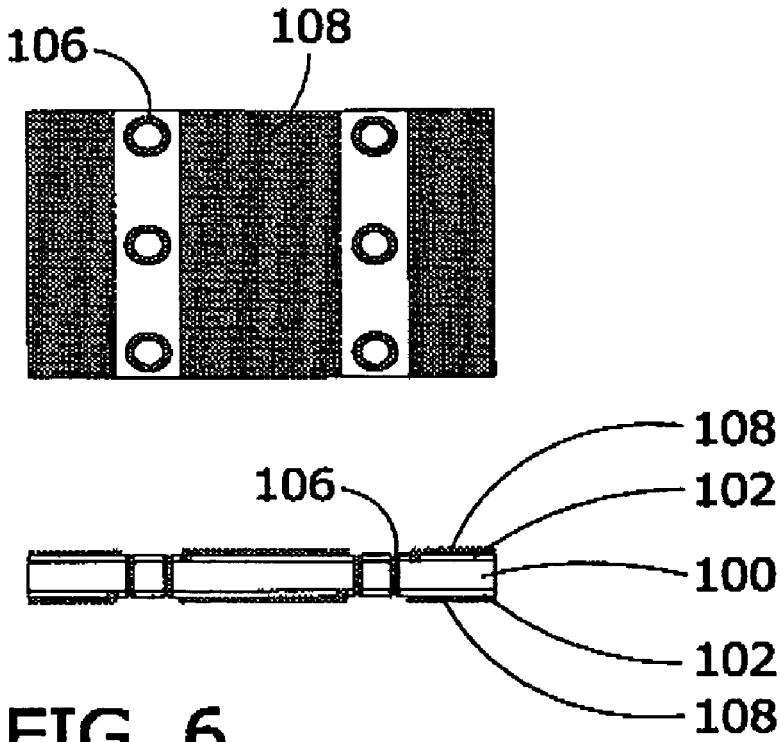
FIG. 5 PRIOR ART
Figure 6:
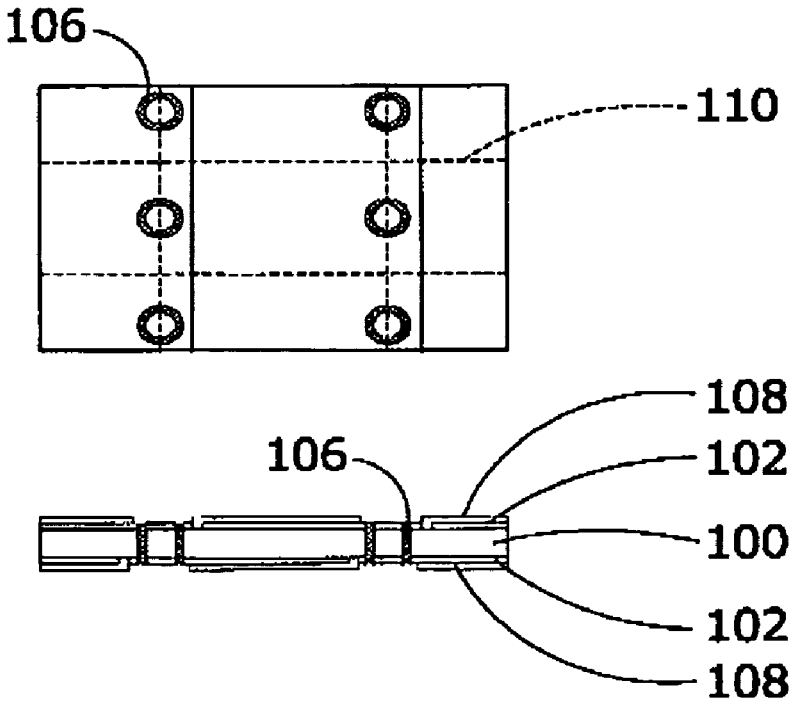
FIG. 6 PRIOR ART
Figure 7:
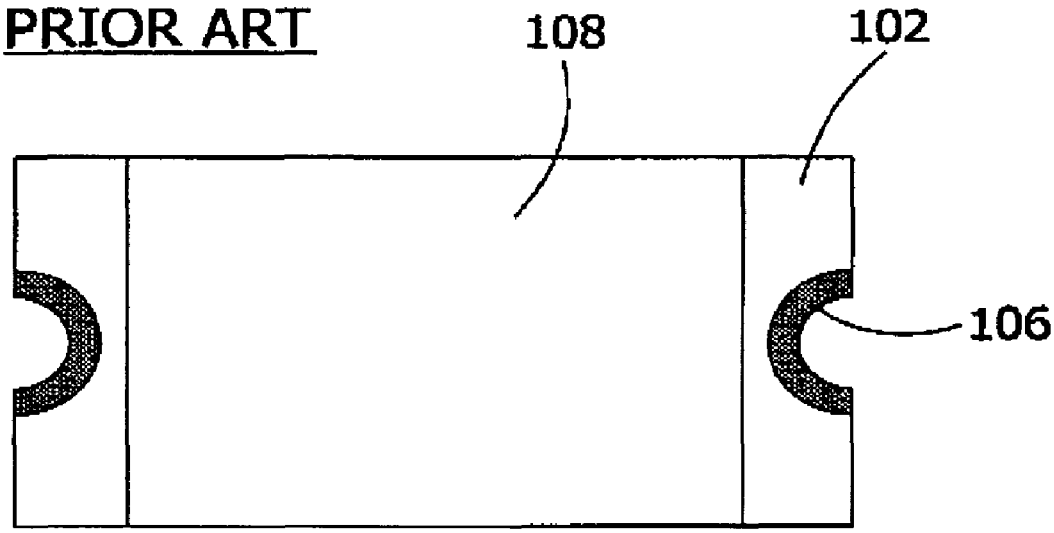
FIG. 7 PRIOR ART
Figure 7:
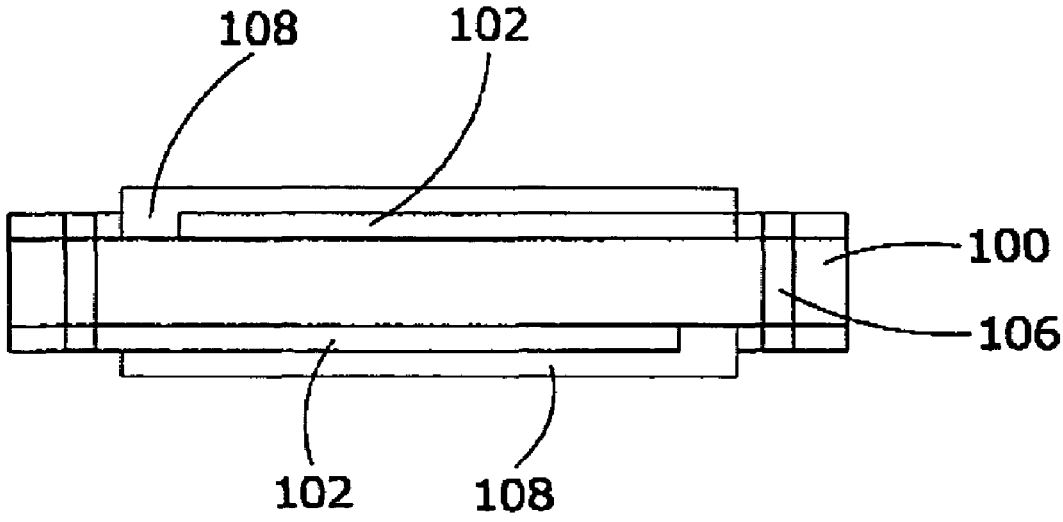
FIG. 7 PRIOR ART
Figure 8:
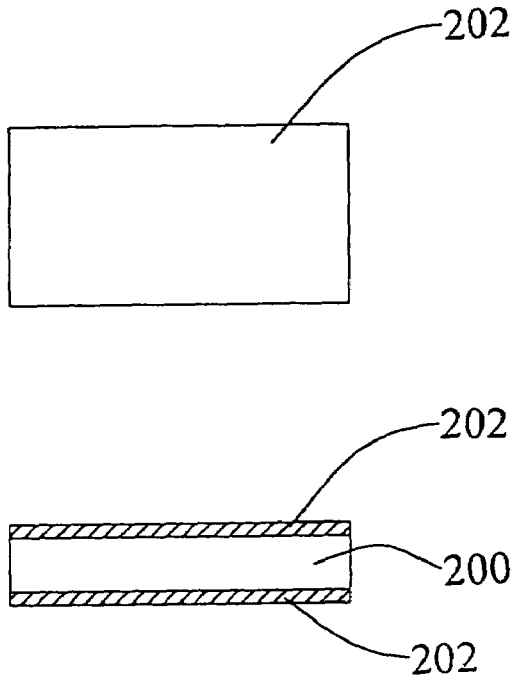
FIGS. 8–11, FIG. 12A and FIG. 13A are schematic diagrams showing a method of manufacturing a surface mounted resettable over-current protection device according to a preferred embodiment of the invention.
Figure 9:
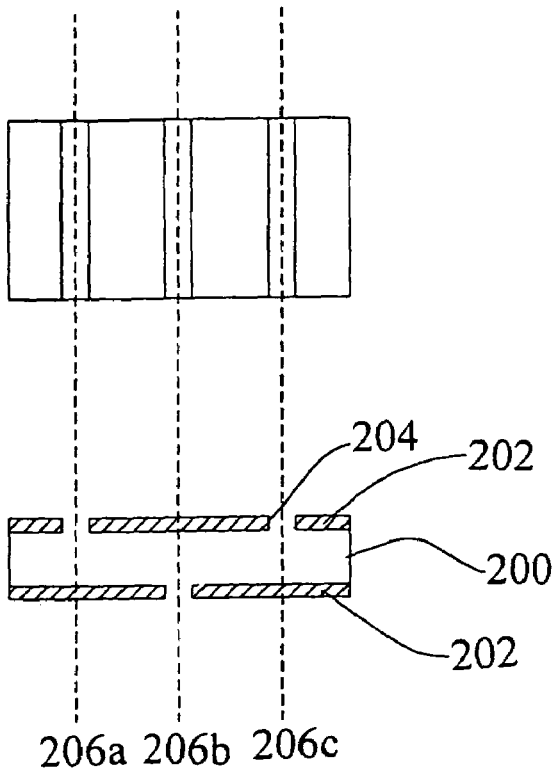

Referring next to FIG. 9, the conducting metal foils 202 on the both sides of the raw material substrate 200 are patterned to form a plurality of trenches 204 therein, such as by photolithography and etching processes or a common cutting process to remove unwanted parts of the conducting metal foils 202, in a printed circuit board manufacture. To facilitate subsequent mass production and cutting, the plurality of trenches 204 on the both sides of the raw material substrate 200 are misaligned, such as along cutting-lines 206*a*, 206*b* and 206*c*.

Figure 10:
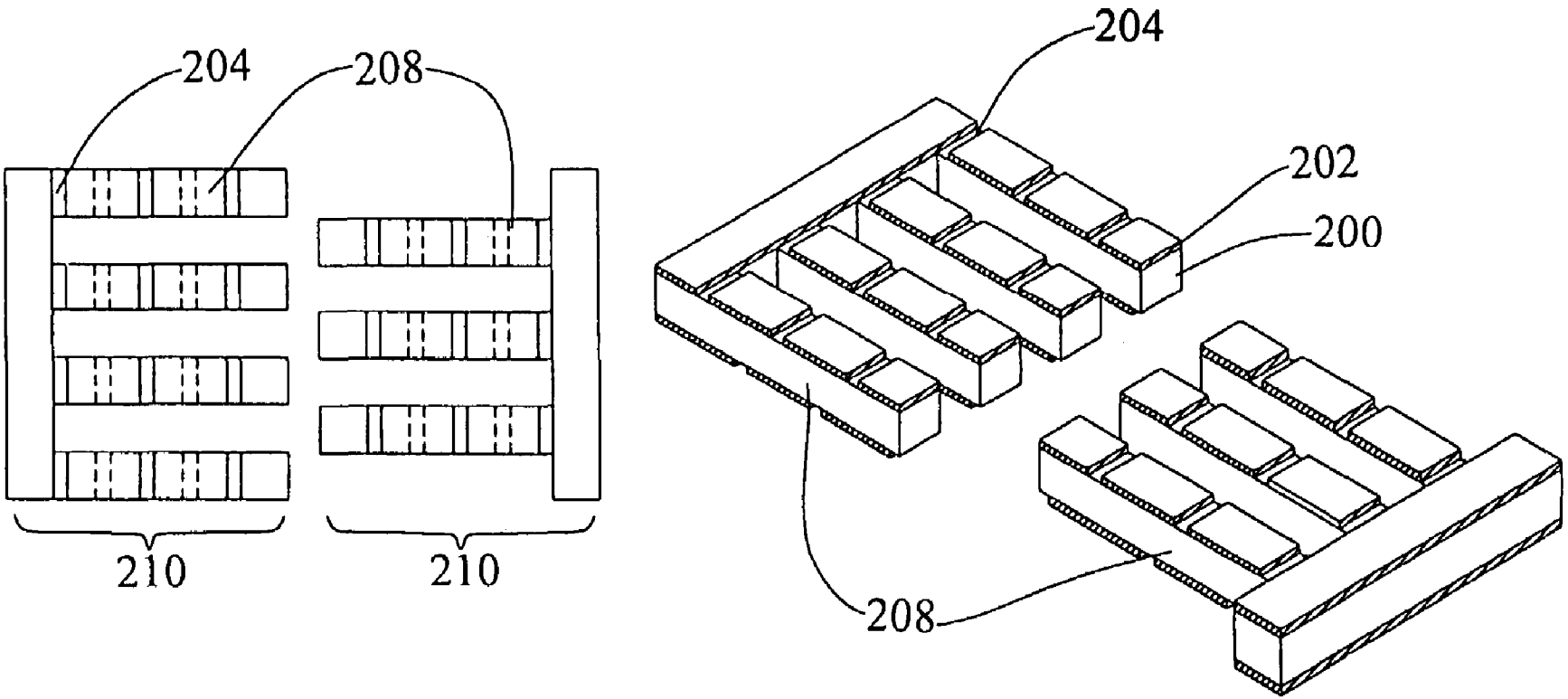

Referring now to FIG. 10, the raw material substrate 200 having the plurality of trenches 204 are cut or punched to form grid-shaped substrates 210 having a plurality of strip-shaped structural parts 208. The number of the grid-shaped substrates 210 formed by punching depends on the area of the raw material substrate 200. For example, two grid-shaped substrates 210 are formed.

Figure 11:
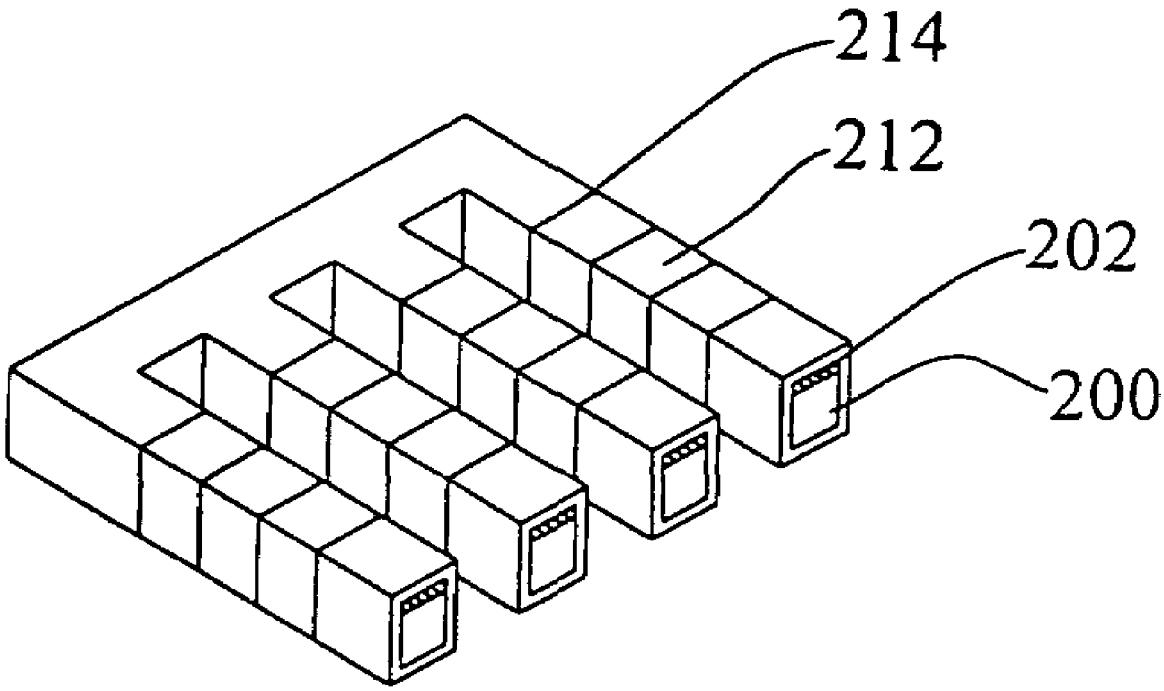
Figure 12A:
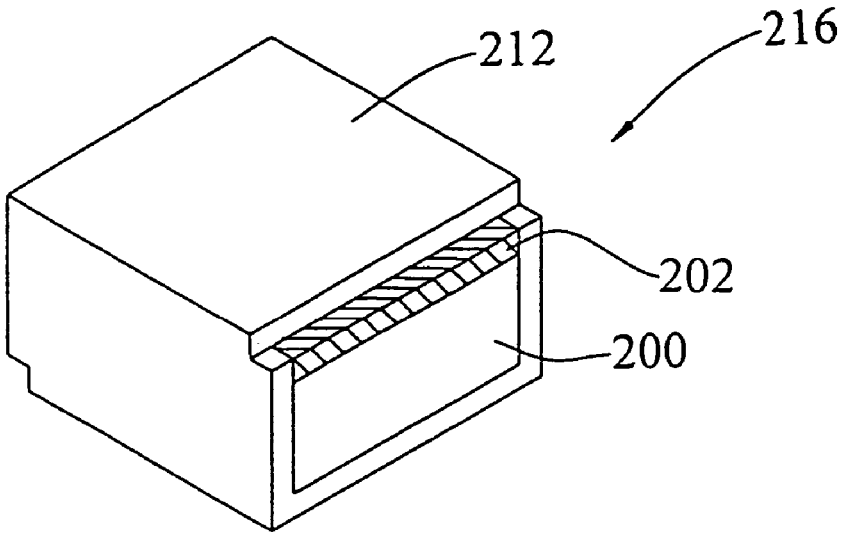
Figure 12B:
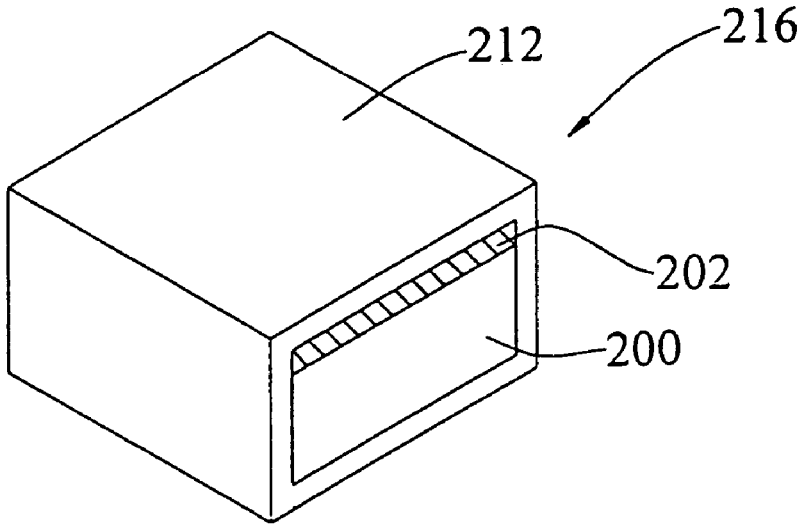

Then, referring simultaneously to FIG. 11, FIG. 12A and FIG. 12B, the plurality of strip-shape structural parts 208 of the grid-shaped substrates 210 are enclosed by an insulating layer 212. Parts of the patterned conducting metal foils 202 and raw material-substrate 200 are exposed only on two ends of the strip-shaped structural parts 208. The insulating layer 212 is formed, for example, by dipping or printing process. Subsequently, the strip-shaped structural parts 208 of the grid-shaped substrates 210 are cut into a plurality of chip 216 along cutting lines 214.

Each chip 216 has two cut ends. As shown in FIGS. 12A and 12B, the end structures of two chips 216 are used to facilitate the process of two terminal electrodes 218 (not shown in FIGS. 12A and 12B) each having five conducting surfaces. FIG. 12A shows an alternative structure of the chip 216 of FIG. 12B, wherein part of the insulating layer 212 adjacent to one cut section is removed to expose part of the patterned conductive metal foil 202. As a result, the contact area between subsequently-formed terminal electrodes 218 (not shown) and the patterned conducting metal foils 202 are increased to enhance the electrical performance of devices.

Figure 13A:
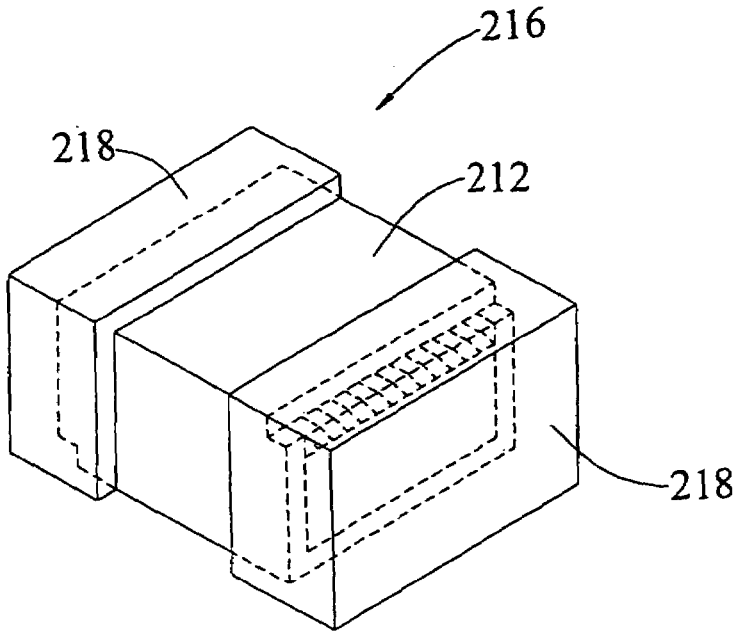
Figure 13B:
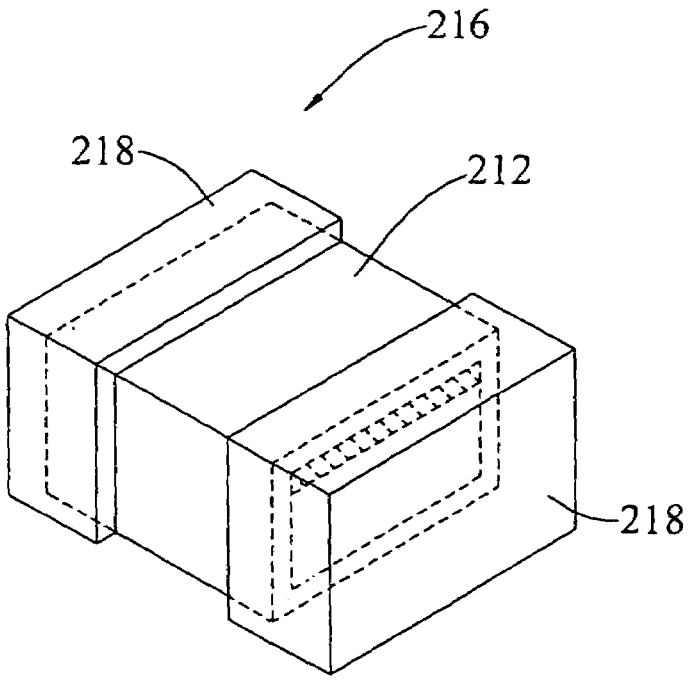

Next, referring to FIGS. 13A and 13B, the terminal electrodes 218 are formed on the both ends of each chip 216 of FIGS. 12A and 12B. The structure of each terminal electrode 218, for example, includes a conducting paste and a soldering layer. The conducting paste, for example, is arranged on one end of the chip 216 and part of the insulating 212 adjacent to the end of the chip 216 and electrically connected to the exposed conducting metal foil 202. The soldering layer, for example, is formed on the conducting paste with the same arrangement. That is, the soldering layer has the same arrangement as and is electrically conducted to the conducting paste. The terminal electrode 218 formed of the conducting paste and soldering layer, for example, has a structure of five conducting surfaces. In FIGS. 13A and 13B, the chips 216 each having two five-conducting surface terminal electrodes 218 are shown. As compared to the conventional terminal electrodes each only having three conducting surfaces, the two terminal electrodes 218 each having a structure of five conducting surfaces greatly increase the contact area. Accordingly, the terminal electrodes 218 have better performances in resistance and adherence.

Figure 14:
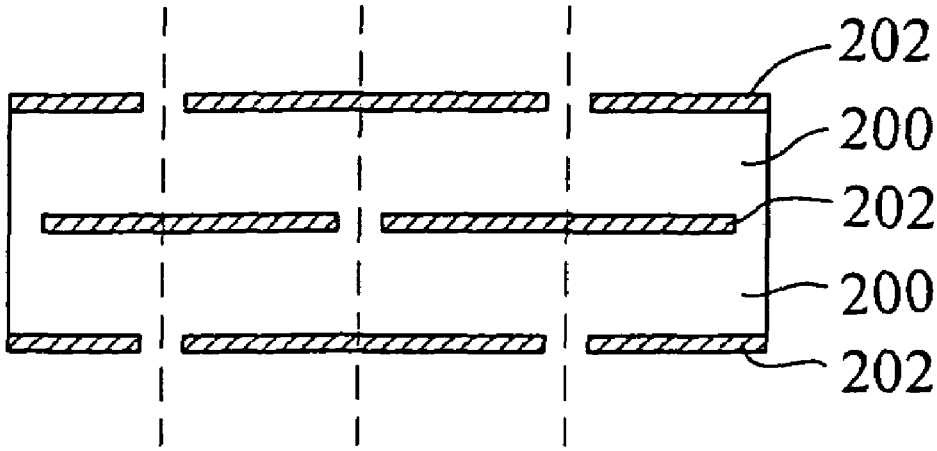
FIG. 14 shows a raw material substrate constructed by two polymer positive temperature coefficient material layers and three conductive metal foil layers which are alternately stacked on each other according to a preferred embodiment of the invention.
Figure 15:
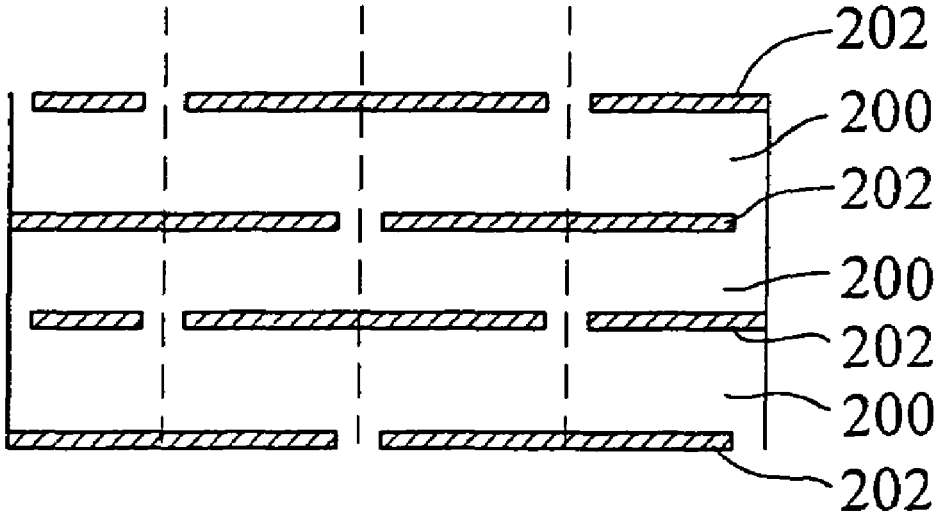
FIG. 15 shows a raw material substrate constructed by three polymer positive temperature coefficient material layers and four conductive metal foil layers which are alternately stacked on each other according to another preferred embodiment of the invention.

Finally, referring to FIGS. 14 and 15, a raw material substrate constructed by two polymer positive temperature coefficient material layers and three conducting metal foil layers and a raw material substrate constructed by three polymer positive temperature coefficient material layers and four conducting metal foil layers according to another preferred embodiment of the invention are shown. The raw material substrate 200 of FIG. 9 is replaced with the raw material substrate constructed by multiple polymer positive temperature coefficient material layers 200 and multiple conducting metal foils 202. A structure of multiple layers reduces the resistance of devices to enhance the performances of the resistance and adherence by increasing effective the contact area.

The raw material substrate constructed by multiple polymer positive temperature coefficient material layers 200 and multiple conducting metal foils 202 are formed by pressing. Moreover, the complexity of the process is reduced thereby, meeting economical requirements.

In summary, a structure of a surface mounted resettable over-current protection device and a method of manufacturing the same according to the present invention have the following advantages:

1. In a structure of a surface mounted resettable over-current protection device of the present invention, terminal electrodes are formed on the both ends of the device while conductors formed in through holes are used to serve as terminal electrodes in the conventional device. Furthermore, the device of the present invention is provided with an insulating layer surrounding the device to increase the reliability of the device. Meanwhile, in the present invention, since terminal electrodes each having a structure of five conducting surfaces are formed on the both ends of the device, the resistance of the terminal electrodes is reduced and the adherence of the terminal electrodes is increased by greatly increasing effective the contact area.
2. In a structure of a surface mounted resettable over-current protection device of the present invention, the terminal electrodes are formed by a mass production passive resistor terminal electrode structure process instead of conventional through hole and eletroplating processes. Therefore, the conventional process is appropriately and economically improved.
3. In a structure of a surface mounted resettable over-current protection device of the present invention, since a raw material substrate can be formed by two or three polymer positive temperature coefficient material layers and three or four conducting metal foil layers which are alternately stacked on each other, the formed device has a better performance.
4. A structure of a surface mounted resettable over-current protection device of the present invention is different from that of the conventional device. Due to the different structures between the present invention and the prior art, the present invention and the prior art are greatly different in process. In other words, the process of the present invention is simple and feasible.

Although the invention has been disclosed in terms of preferred embodiments, the disclosure is not intended to limit the invention. Those knowledgeable in the art can make modifications within the scope and spirit of the invention which is determined by the claims below.

What is claimed is:

1. A method of manufacturing a surface mounted resettable over-current protection device, comprising the steps of:

providing a raw material substrate having two ends, on each of the two ends of which a patterned conducting metal foil is arranged;

cutting the raw material substrate to form a grid-shaped substrate having a plurality of strip-shaped structural parts;

forming an insulating layer, the insulating layer enclosing the grid-shaped substrate, and allowing parts of the patterned metal foils adjacent to the both ends of the strip-shaped structural parts to be exposed;

cutting the strip-shaped structural parts of the grid-shaped substrate into a plurality of chips, each of the chips having two cut sections; and forming two terminal electrodes on the two cut sections, respectively, the two terminal electrodes enclosing the insulating layer and the two cut sections exposing parts of the patterned conducting metal foils, the two terminal electrodes electrically connected to the two cut sections which exposes the parts of the patterned conducting metal foils.

2. The method as claimed in claim 1, wherein the raw material substrate has at least a polymer positive temperature coefficient material layer.

3. The method as claimed in claim 1, wherein the raw material substrate is formed by pressing polymer positive temperature coefficient material layer and multiple conducting metal foil layers which are alternately stacked on each other.

4. The method as claimed in claim 3, wherein the raw material substrate is formed by pressing three polymer positive temperature coefficient material layers and four conducting metal foil layers which are alternately stacked on each other.

5. The method as claimed in claim 1, wherein the patterned conducting metal foils have a plurality of trenches to divide the patterned conducting metal foils into a plurality of regions.

6. The method as claimed in claim 5, wherein the insulating layer is added to the trenches to electrically insulate the terminal electrodes from the patterned conducting metal foils.

7. The method as claimed in claim 1, wherein the insulating layer is formed by a dipping or printing process.

8. The method as claimed in claim 1, further comprising the steps of:

coating a conducting paste on the two ends of the raw material substrate, the conducting paste electrically connected to one cut section which exposes the parts of the patterned conducting metal foils; and forming a soldering layer on and electrically connected to the conducting paste, the soldering layer including a nickel layer and a tin/lead alloy layer.

9. The method as claimed in claim 8, wherein the soldering layer is formed by electroplating.

10. A surface mounted resettable over-current protection device manufactured by the method of claim 1.

11. The surface mounted resettable over-current protection device as claimed in claim 10, wherein the raw material substrate has at least a polymer positive temperature coefficient material layer.

12. The surface mounted resettable over-current protection device as claimed in claim 10, wherein the patterned conducting metal foil covers part of the raw material substrate, and the two ends of the raw material substrate are exposed.

13. The surface mounted resettable over-current protection device as claimed in claim 10, wherein the insulating layer covers edges of the raw material substrate and is used to electrically insulate the patterned conducting metal foil layers from the terminal electrodes.

14. The surface mounted resettable over-current protection device as claimed in claim 10, wherein each terminal electrode further comprising:

a conducting paste, arranged on one end of the raw material substrate and electrically connected to the exposed cut section of the patterned conducting metal foil; and a soldering layer, including a nickel layer and a tin/lead alloy layer and arranged on and electrically connected to the conducting paste.

* * * * *